US011788313B2

(12) United States Patent
Huang et al.

(10) Patent No.: US 11,788,313 B2
(45) Date of Patent: Oct. 17, 2023

(54) POOL CLEANER WITH MOVEABLE WATERWAY

(71) Applicant: INTEX MARKETING LTD., Tortola (VG)

(72) Inventors: Zhi Xiong Huang, Fujian (CN); Wen Xiao Zhang, Fujian (CN)

(73) Assignee: Intex Marketing Ltd., Tortola (VG)

( * ) Notice: Subject to any disclaimer, the term of this patent is extended or adjusted under 35 U.S.C. 154(b) by 80 days.

(21) Appl. No.: 17/612,484

(22) PCT Filed: May 21, 2020

(86) PCT No.: PCT/IB2020/054855

§ 371 (c)(1),
(2) Date: Nov. 18, 2021

(87) PCT Pub. No.: WO2020/234831

PCT Pub. Date: Nov. 26, 2020

(65) Prior Publication Data

US 2022/0228390 A1 Jul. 21, 2022

(30) Foreign Application Priority Data

May 21, 2019 (CN) ..... 201920733644.X
May 21, 2019 (CN) ..... 201920735873.5

(51) Int. Cl.
*E04H 4/16* (2006.01)

(52) U.S. Cl.
CPC ..... *E04H 4/1672* (2013.01); *E04H 4/16* (2013.01); *E04H 4/1654* (2013.01)

(58) Field of Classification Search
CPC ..... E04H 4/16; E04H 4/1672; E04H 4/1654
See application file for complete search history.

(56) References Cited

U.S. PATENT DOCUMENTS

| | | | |
|---|---|---|---|
| 5,896,610 | A | 4/1999 | Sebor et al. |
| 9,745,767 | B2 | 8/2017 | Renaud |
| 2008/0307589 | A1 | 12/2008 | Schneider |
| 2015/0020368 | A1 | 1/2015 | Rief |

(Continued)

FOREIGN PATENT DOCUMENTS

| | | | |
|---|---|---|---|
| CA | 3031667 | A1 | 2/2018 |
| CN | 102828625 | | 12/2012 |

(Continued)

OTHER PUBLICATIONS

National Intellectual Property Administration, PRC, International Search Report and Written Opinion for International Application No. PCT/IB2020/054855, dated Sep. 3, 2020.

(Continued)

*Primary Examiner* — Michael D Jennings
(74) *Attorney, Agent, or Firm* — Faegre Drinker Biddle & Reath LLP

(57) ABSTRACT

A pool cleaner equipped with a joint and a water inlet hose is disclosed. In a rotatable or use configuration, the water inlet hose is freely rotatable relative to a housing to avoid entanglement. In a locked or non-use configuration, either the joint or the water inlet hose is fixed relative to the housing to facilitate installation and/or removal of the water inlet hose via rotation between the joint and the water inlet hose.

14 Claims, 15 Drawing Sheets

(56) References Cited

U.S. PATENT DOCUMENTS

| | | | | |
|---|---|---|---|---|
| 2016/0145884 | A1* | 5/2016 | Erlich | E04H 4/1654 15/1.7 |
| 2016/0215516 | A1* | 7/2016 | Hayes | B04C 5/26 |
| 2018/0163422 | A1* | 6/2018 | Klebanov | C02F 1/001 |
| 2018/0172114 | A1* | 6/2018 | Stoltz | F16H 3/34 |
| 2018/0328059 | A1* | 11/2018 | Hayes | E04H 4/1654 |
| 2019/0203490 | A1* | 7/2019 | Borg | E04H 4/1672 |

FOREIGN PATENT DOCUMENTS

| | | | |
|---|---|---|---|
| CN | 205065124 | U | 3/2016 |
| CN | 207277924 | U | 4/2018 |
| CN | 207526181 | U | 6/2018 |
| CN | 109723251 | A | 5/2019 |
| CN | 210106835 | U | 2/2020 |
| CN | 210239260 | U | 4/2020 |
| DE | 2612043 | | 9/1977 |
| RU | 97156 | | 8/2010 |
| WO | 2004097145 | A1 | 11/2004 |
| WO | 2019/058286 | | 3/2019 |

OTHER PUBLICATIONS

Extended Search Report issued by the European Patent Office, dated May 3, 2023, for European Patent Application No. 20808672.8; 6 pages.

Communication pursuant to Rules 161(2) and 162 EPC issued by the European Patent Office, dated Jan. 5, 2022, for European Patent Application No. 20808672.8; 3 pages.

International Preliminary Report on Patentability issued by The International Bureau of WIPO, dated Nov. 16, 2021, for PCT Patent Application No. PCT/IB2020/054855; 7 pages.

Search Report issued by the Federal Service on Intellectual Property (FIPS), dated Jun. 27, 2023, for Russian Patent Application No. 2021133569; 2 pages.

English translation of Search Report issued by the Federal Service on Intellectual Property (FIPS), dated Jun. 27, 2023, for Russian Patent Application No. 2021133569; 2 pages.

* cited by examiner

POOL CLEANER WITH MOVEABLE WATERWAY

CROSS REFERENCE TO RELATED APPLICATION

This application is a national stage application of International Application No. PCT/IB2020/054855, filed May 21, 2020, which claims priority to Chinese Application Serial Nos. CN201920733644.X and CN201920735873.5, both filed May 21, 2019, the disclosures of which are hereby expressly incorporated by reference herein in their entireties.

FIELD OF THE DISCLOSURE

The present invention relates to the field of pool cleaners, and in particular to a pool cleaner having a rotatable and releasable hose assembly, and to methods of using the same.

BACKGROUND OF THE DISCLOSURE

A pool cleaner may be equipped with a. hydraulic driving assembly. In operation, a flexible water inlet hose may direct water to the hydraulic driving assembly to drive the pool cleaner back and forth across the pool. It may be desirable for the water inlet hose to move relative to a housing of the pool cleaner to avoid entanglement during this back and forth movement. However, providing such movement relative to the housing may inhibit installation and/or removal of the water inlet hose.

SUMMARY

The present disclosure provides a pool cleaner equipped with a joint and a water inlet hose. In a rotatable or use configuration, the water inlet hose is freely rotatable relative to a housing to avoid entanglement. In a locked or non-use configuration, either the joint or the water inlet hose is fixed relative to the housing to facilitate installation and/or removal of the water inlet hose via rotation between the joint and the water inlet hose.

According to an exemplary embodiment of the present disclosure, a pool cleaner configured to clean a pool is disclosed, the pool cleaner including a housing having a through-hole, a flexible water inlet hose, a hydraulic driving assembly including a water inlet, at least one traction assembly operably coupled to the driving assembly, and a joint extending through the through-hole of the housing and including an upper end in fluid communication with the water inlet hose and a lower end in fluid communication with the water inlet. The pool cleaner has a rotatable configuration in which the flexible water inlet hose and the joint are coupled together and rotatable together relative to the housing, arid a locked configuration in which one of the joint and the water inlet hose is a locked component that is restricted from rotating relative to the housing and the other of the joint and the water inlet hose is a rotatable component that is rotatable relative to the housing, wherein the joint and the water inlet hose are selectively coupled together via rotation of the rotatable component relative to the locked component in the locked configuration.

In certain embodiments, the joint floats upward in the housing in the rotatable configuration and falls downward in the housing due to gravity in the locked configuration.

In certain embodiments, the joint is the locked component and the water inlet hose is the rotatable component in the locked configuration. The water inlet may include at least one locking protrusion, and the joint may include at least one locking slot that is separated from the at least one locking protrusion in the rotatable configuration and engaged with the at least one locking protrusion in the locked configuration. The joint may include a mounting rib, and the water inlet hose may include a mounting hole that is rotatable relative to the mounting rib in the locked configuration to selectively couple the joint and the water inlet hose together. The mounting rib of the joint may include a locking protrusion, and the mounting hole of the water inlet hose may include a locking recess that receives the locking protrusion to secure the joint and the water inlet hose together.

In certain embodiments, the water inlet hose is the locked component and the joint is the rotatable component in the locked configuration. The pool cleaner may further include a. rotary sleeve coupled to the joint and configured to rotate the joint relative to the water inlet hose in the locked configuration. The rotary sleeve may be positioned atop the housing.

In certain embodiments, the water inlet hose and the joint are threaded together.

In certain embodiments, the pool cleaner further includes a bearing positioned between the joint and the housing.

In certain embodiments, the pool cleaner further includes a seal positioned between the joint and the water inlet.

According to an exemplary embodiment of the present disclosure, a pool cleaner configured to clean a pool is disclosed, the pool cleaner including a housing having a through-hole, a flexible water inlet hose, a hydraulic driving assembly including a water inlet, at least one traction assembly operably coupled to the driving assembly, and a joint extending through the through-hole of the housing and including an upper end in fluid communication with the water inlet hose and a lower end in fluid communication with the water inlet. The joint has a rotatable configuration in which the lower end of the joint is rotatable relative to the water inlet, and a locked configuration in which the lower end of the joint is restricted from rotating relative to the water inlet and the water inlet hose is rotatable relative to the upper end of the joint.

In certain embodiments, the water inlet includes at least one locking protrusion and the joint includes at least one locking slot. In the rotatable configuration, the at least one locking slot floats above the at least one locking protrusion. In the locked configuration, the at least one locking slot moves downward and engages the at least one locking protrusion.

According to another exemplary embodiment of the present disclosure, a method of using a pool cleaner is disclosed. The pool cleaner has a housing, a hydraulic driving assembly with a water inlet, and a joint. The method includes the steps of moving the pool cleaner across a pool by directing water from a water inlet hose, through the joint, and through the water inlet of the hydraulic driving assembly, wherein the joint and the water inlet hose rotate together relative to the water inlet during the moving step, and removing the water inlet hose by restricting rotation of the joint relative to the housing and rotating the water inlet hose relative to the housing and the joint.

In certain embodiments, the method further includes installing the water inlet hose by restricting rotation of the joint relative to the housing and rotating the water inlet hose relative to the housing and the joint in an opposite direction as the removing step.

In certain embodiments, the joint floats upward during the moving step and moves downward to engage the water inlet during the removing step.

According to yet another exemplary embodiment of the present disclosure, a method of using a pool cleaner is disclosed. The pool cleaner has a housing, a hydraulic driving assembly with a water inlet, and a rotatable joint coupled to a sleeve. The method includes the steps of moving the pool cleaner across a pool by directing water from a water inlet hose, through the rotatable joint, and through the water inlet of the hydraulic driving assembly, wherein the joint and the water inlet hose rotate together relative to the water inlet during the moving step, and removing the water inlet hose by restricting rotation of the water inlet hose relative to the housing and rotating the sleeve relative to the housing, wherein the rotatable joint rotates relative to the water inlet and relative to the water inlet hose during the removing step.

In certain embodiments, the sleeve sits atop the housing.

In certain embodiments, the method further includes installing the water inlet hose by restricting rotation of the water inlet hose relative to the housing and rotating the sleeve relative to the housing in an opposite direction as the removing step, wherein the rotatable joint rotates in the opposite direction relative to the water inlet and relative to the water inlet hose during the installing step.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

I. First Embodiment with Rotatable and Lockable Joint

Figure 1:
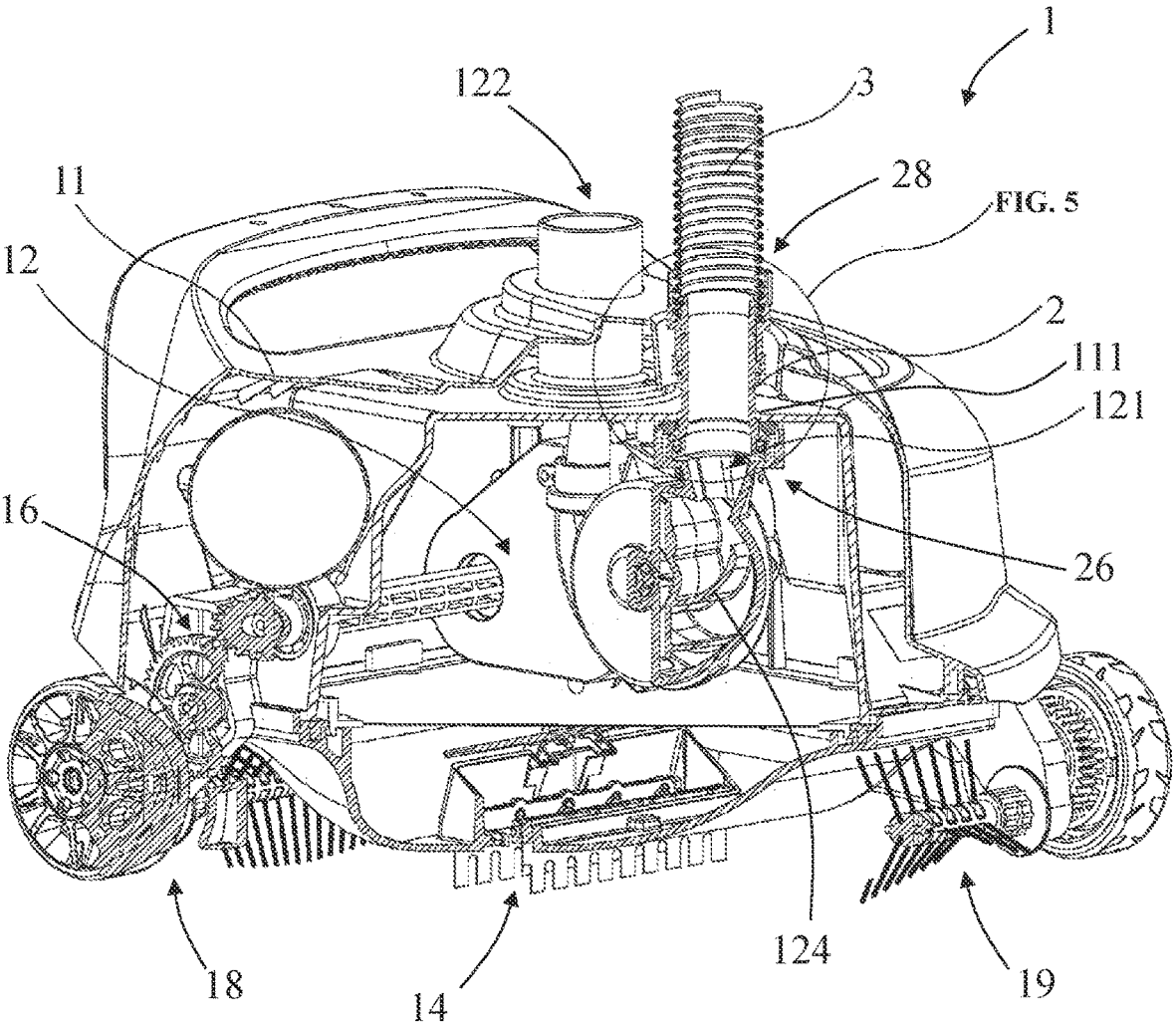
FIG. 1 is a perspective, partially cross-sectional view of a first pool cleaner including an exemplary joint coupled to a water inlet hose.

FIG. 1 provides a first embodiment of a pool cleaner 1 configured to clean a floor and/or sidewalk of a pool. The pool cleaner 1 includes a housing 11 that defines a through-hole 111 in its upper surface. The pool cleaner 1 also includes a hydraulic driving assembly 12 including a water inlet 121 adjacent to the through-hole 111, a water outlet 122, and an impeller 124 disposed within the housing 11 and in fluid communication between the water inlet 121 and the water outlet 122. The pool cleaner 1 also includes a filtration assembly 14 disposed within the housing 11 to collect debris. The pool cleaner 1 further includes a transmission assembly 16 operably coupled to the driving assembly 12 and including a plurality of gears. The pool cleaner 1 further includes one or more wheels 18 or other traction assemblies (e.g., tracks) and one or more brush assemblies 19 operably coupled to the transmission assembly 16.

The pool cleaner 1 also includes a joint 2 configured to receive a flexible water inlet hose 3, illustratively a corrugated hose. The joint 2 passes through the through-hole 111 of the housing 11. A lower end 26 of the joint 2 has a rotatable or use configuration and a locked or non-use configuration relative to the housing 11 and the water inlet 121. An upper end 28 of the joint 2 is removably coupled to the water inlet hose 3 via rotation. In this way, the rotatable configuration of the joint 2 allows the water inlet hose 3 to rotate relative to the housing 11 during use, and the locked configuration of the joint 2 facilitates installation and/or removal of the water inlet hose 3 via rotation when not in use. The joint 2 and its operation are described further below.

When the pool cleaner 1 is in use, water is directed through a waterway including the water inlet hose 3, the joint 2, and the water inlet 121, across the impeller 124, and out of the water outlet 122, which rotates the impeller 124. The rotation of the impeller 124 is transferred to the brush assembly 19 via the transmission assembly 16, which causes the brush assembly 19 to rotate and direct debris into the filtration assembly 14. The rotation of the impeller 124 is also transferred to the wheels 18 via the transmission assembly 16, which causes the pool cleaner 1 to drive back and forth across the pool. With the joint 2 in the rotatable configuration, the water inlet hose 3 is able to rotate freely relative to the housing 11 and the water inlet 121 during this back and forth movement, thus avoiding entangling of the water inlet hose 3.

Figure 2:
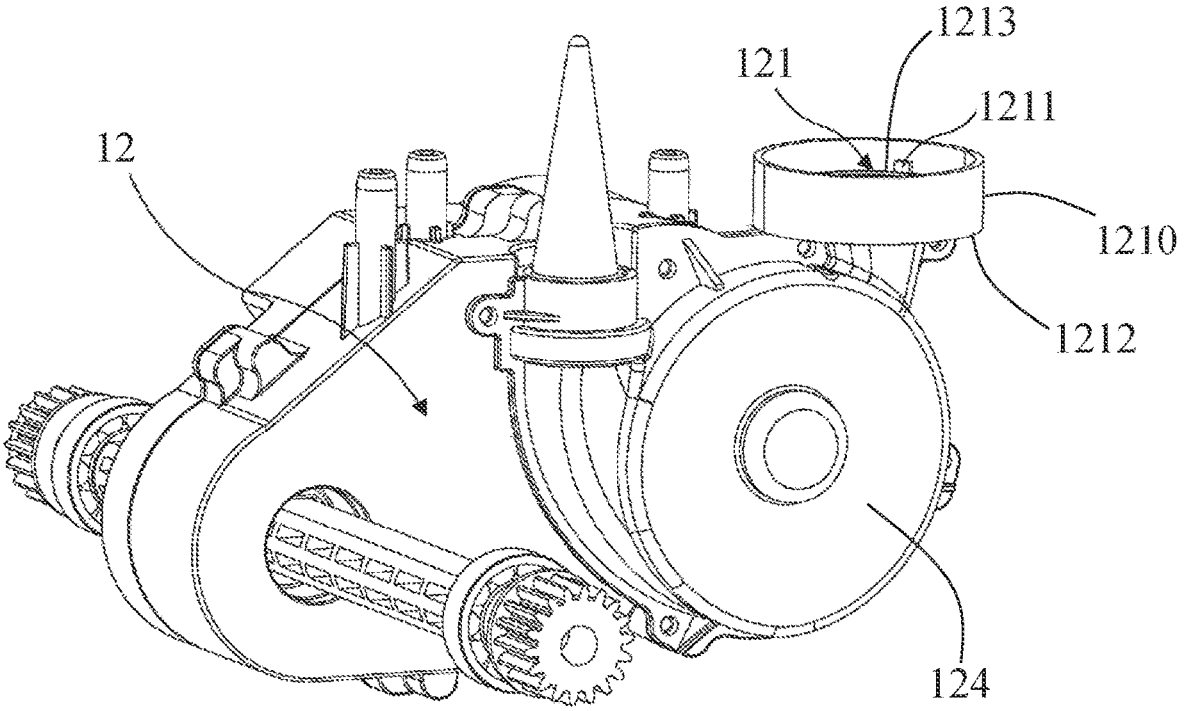
FIG. 2 is a perspective view of a hydraulic driving assembly of the pool cleaner of FIG. 1.

The driving assembly 12 is shown in FIG. 2 The water inlet 121 of the driving assembly 12 includes a cylindrical side wall 1210, one or more rotation-locking protrusions 1211 protruding radially inward from the side wall 1210, a base or flange 1212 extending radially inward from the bottom of the side wall 1210 (See also FIG. 5), and an annular retaining wall 1213 that extends upward from the base 1212 in a direction parallel to the side wall 1210 and at a location radially inward of the side wall 1210.

Figure 3:
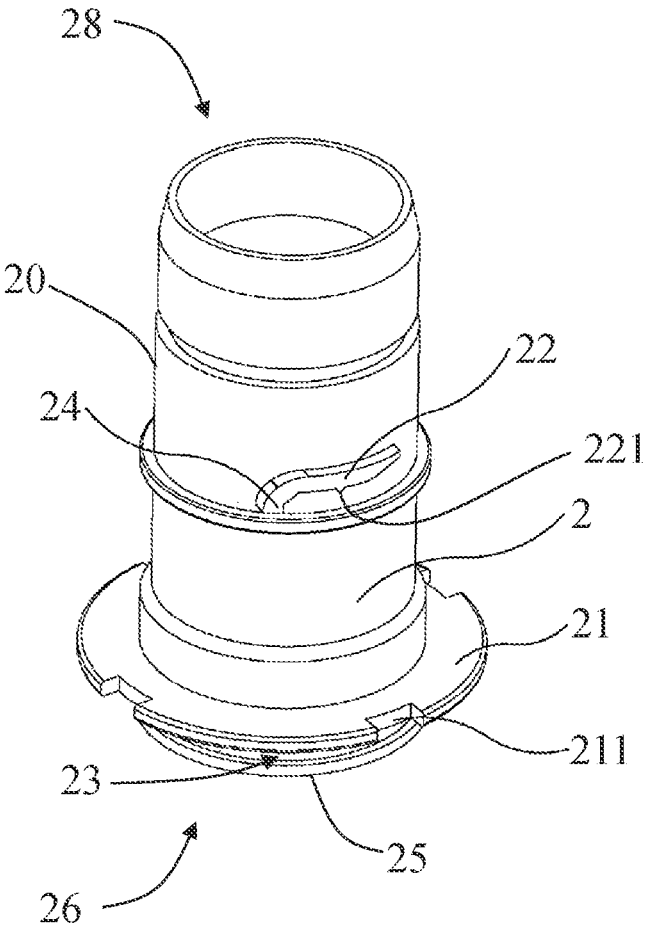
FIG. 3 is a perspective view of the joint of FIG. 1.
Figure 5:
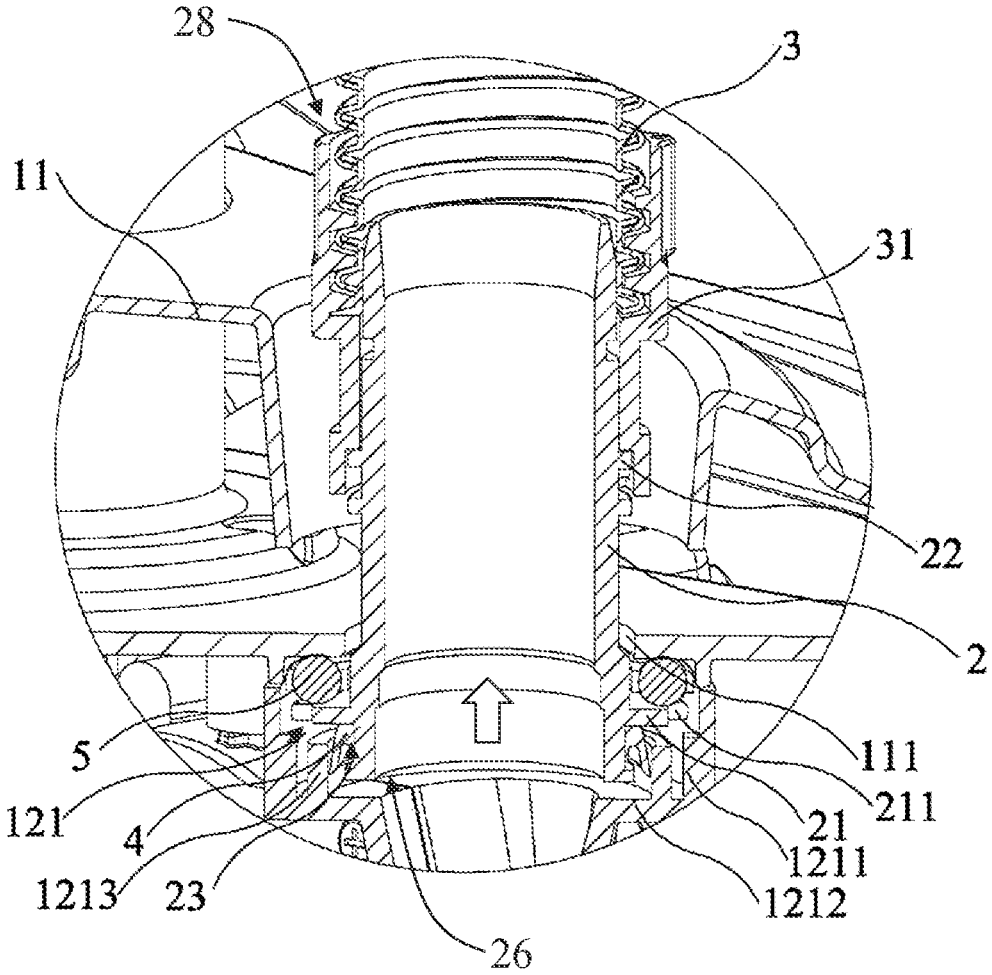
FIG. 5 is an enlarged view of the circled area of FIG. 1, with the joint shown in a rotatable configuration.

The joint 2 is shown in FIG. 3. The joint 2 is a tubular structure including a generally cylindrical side wall 20 that extends between the lower end 26 and the upper end 28. A flange 21 extends radially outward from the side wall 20 and includes one or more rotation-locking slots 211 positioned along the perimeter of the flange 21. Below the flange 21, a foot 25 extends radially outward from the lower end 26 of the side wall 20. The flange 21 and the foot 25 cooperate to define a groove 23 configured to receive a seal 4 (e.g., a V-ring) (FIG. 5). Above the flange 21, the joint 2 is configured to support a thrust bearing 5 (FIG. 5). The joint 2 also includes a mounting rib 22 that protrudes outward from the side wall 20 in a circumferential direction and then bends axially at one end to form a stop 24. One or more locking protrusions 221 protrude axially from the mounting rib 22.

Figure 4:
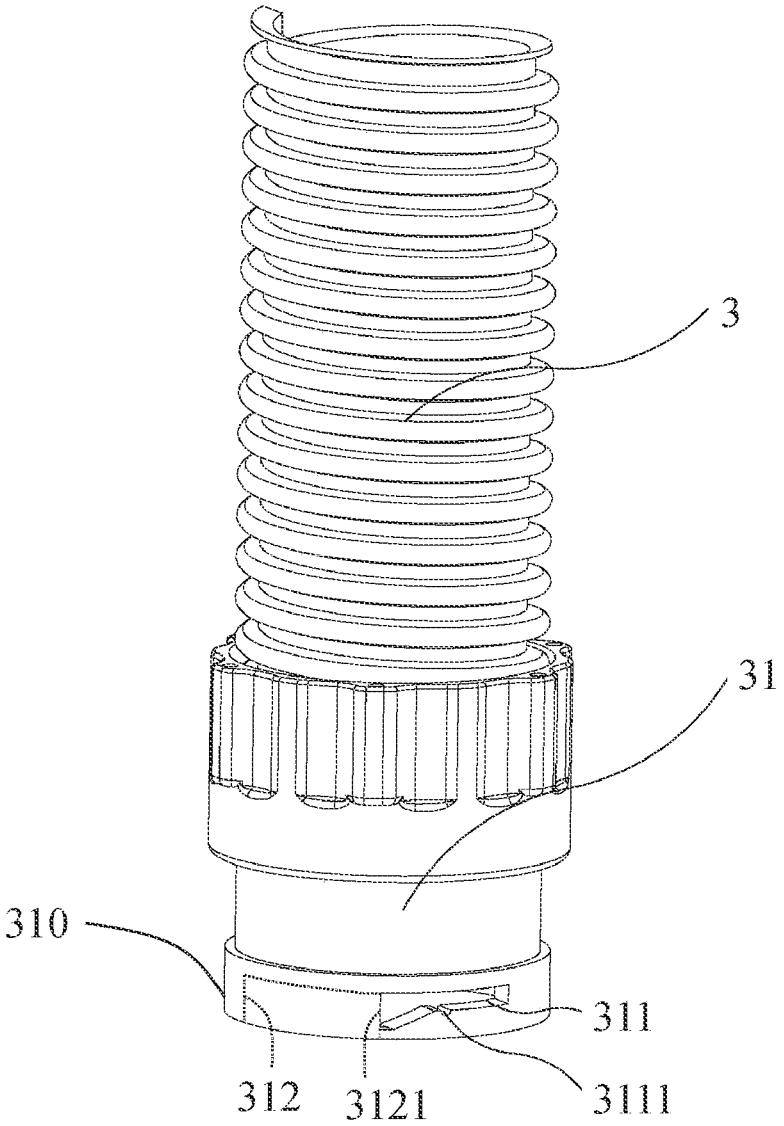
FIG. 4 is a perspective view of a distal end of the water inlet hose of FIG. 1.

The water inlet hose 3 is shown in FIG. 4. A coupling 31 is coupled (e.g., screwed, welded, adhered) to a distal end of the water inlet hose 3. The coupling 31 includes a cylindrical side wall 310 with a mounting hole 311 that extends through the side wall 310 in a circumferential direction. One or more locking recesses 3111 extend axially into the mounting hole 311. Along the inner surface of the cylindrical side wall 310, the coupling 31 also includes a mounting groove 312 that is open at its lower end and includes a side notch 3121 that communicates with the mounting hole 311 (See also FIG. 7).

The operation of the joint 2 will now he described with reference to FIGS. 5-10.

In FIG. 5, the joint 2 is shown in the rotatable or use configuration, in which the joint 2 is positioned in the pool and floats upward in the water. The flange 21 of the joint 2 is located below the through-hole 111 of the housing 11 and has an outer diameter larger than an inner diameter of the through-hole 111, thereby limiting, upward movement of the joint 2 in the housing 11 and preventing detachment of the joint 2 from the housing 11. In this rotatable configuration, the rotation-locking slots 211 on the flange 21 are raised above and separated from the rotation-locking protrusions 1211 of the water inlet 121, which allows the joint 2 to rotate freely relative to the housing 11 and the water inlet 121. As noted above, the rotatable joint 2 avoids entangling of the water inlet hose 3 during back-and-forth movement of the pool cleaner 1 (FIG. 1). The seal 4 is captured in the groove 23 of the rotatable joint 2 and contacts the annular retaining wall 1213 of the water inlet 121, which ensures a water-tight pathway from the joint 2 to the water inlet 121. Also, the thrust bearing 5 is captured between the flange 21 of the rotatable joint 2 and the housing 11, which facilitates smooth rotation of the joint 2 in the through-hole 111 of the housing 11.

Figure 6:
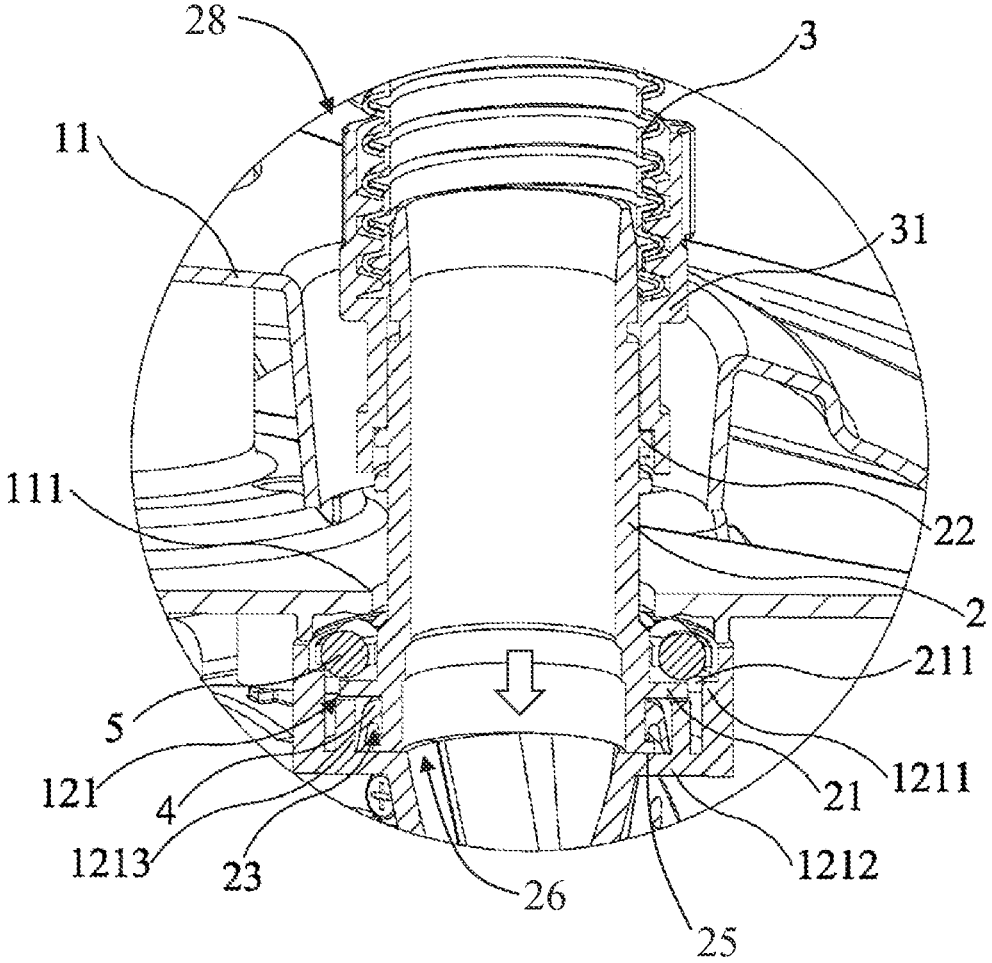
FIG. 6 is an enlarged view similar to FIG. 5, with the joint shown in a locked configuration.

In FIG. 6, the joint 2 is shown in the locked or non-use configuration, in which the joint 2 is removed from the pool and falls downward into the water inlet 121 due to gravity. Initially, the flange 21 of the joint 2 may sit atop the upper end of the rotation-locking protrusion 1211 of the water inlet 121. The joint 2 may be rotated until the rotation-locking slots 211 of the flange 21 align with and engage the rotation-locking protrusion 1211 of the water inlet 121, thereby fully seating the joint 2 in the locked configuration of FIG. 6. The foot 25 of the joint 2 contacts the base 1212 of the water inlet 121, and the flange 21 of the joint 2 contacts the annular retaining wall 1213 of the water inlet 121. The foot 25 and the flange 21 have outer diameters larger than the inner diameters of the base 1212. and the annular retaining wall 1213, respectively, thereby limiting downward movement of the joint 2 and preventing the joint 2 from falling into the water inlet 121. In this locked configuration, the joint 2 is restricted from rotating relative to the housing 11 and the water inlet 121.

Figure 7:
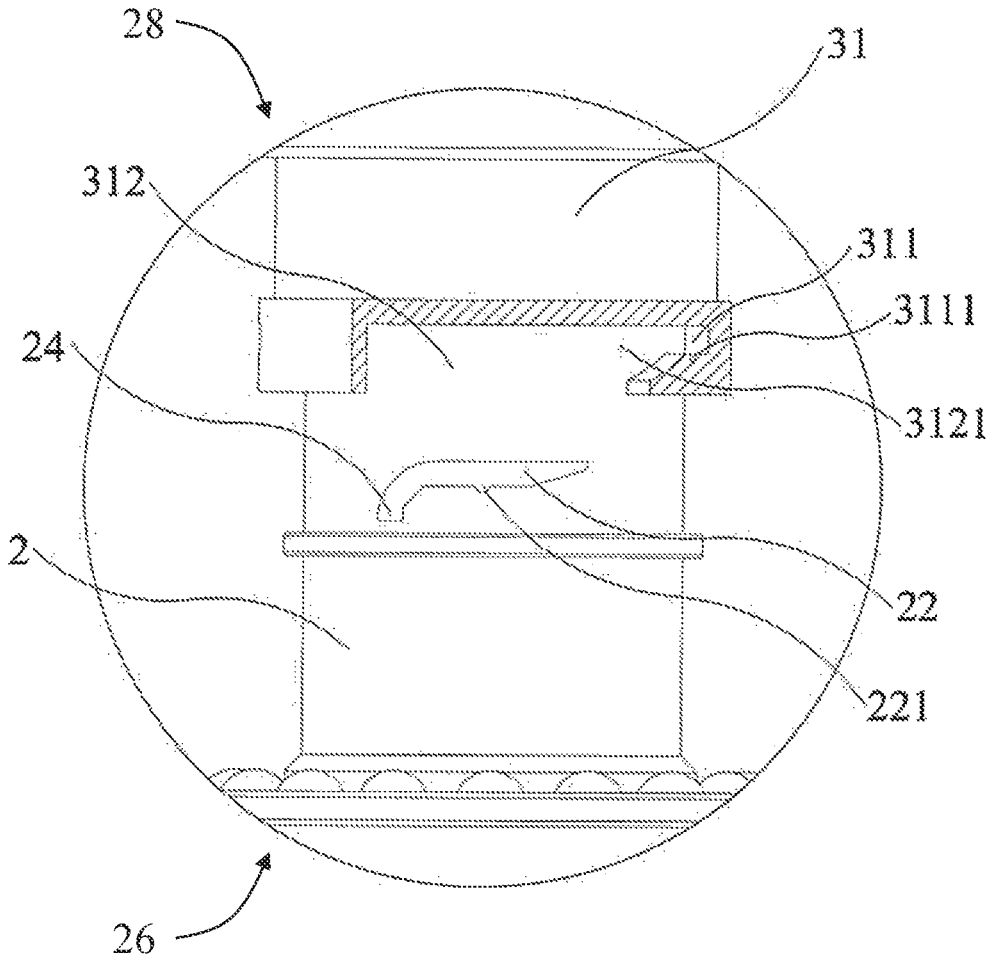
FIGS. 7-10 are elevational, partially cross-sectional views showing installation of the water inlet hose onto the locked joint of FIG. 6.
Figure 8:
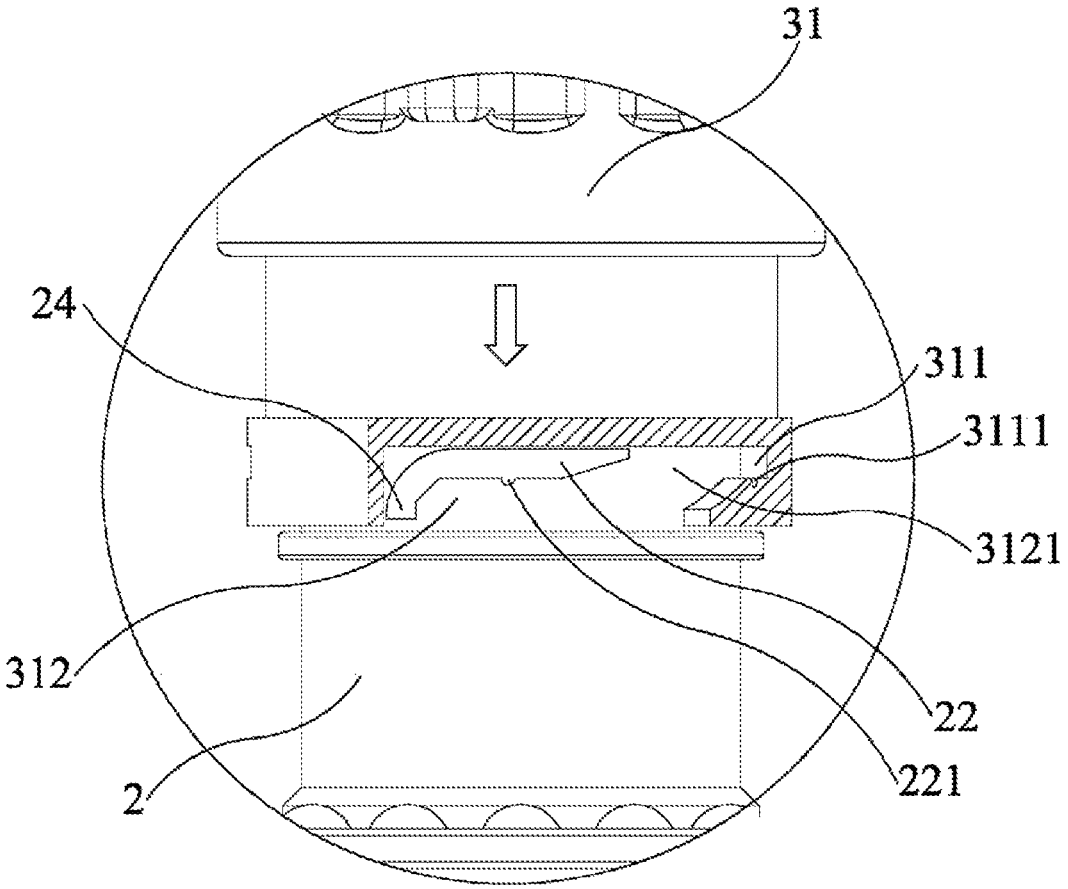
Figure 9:
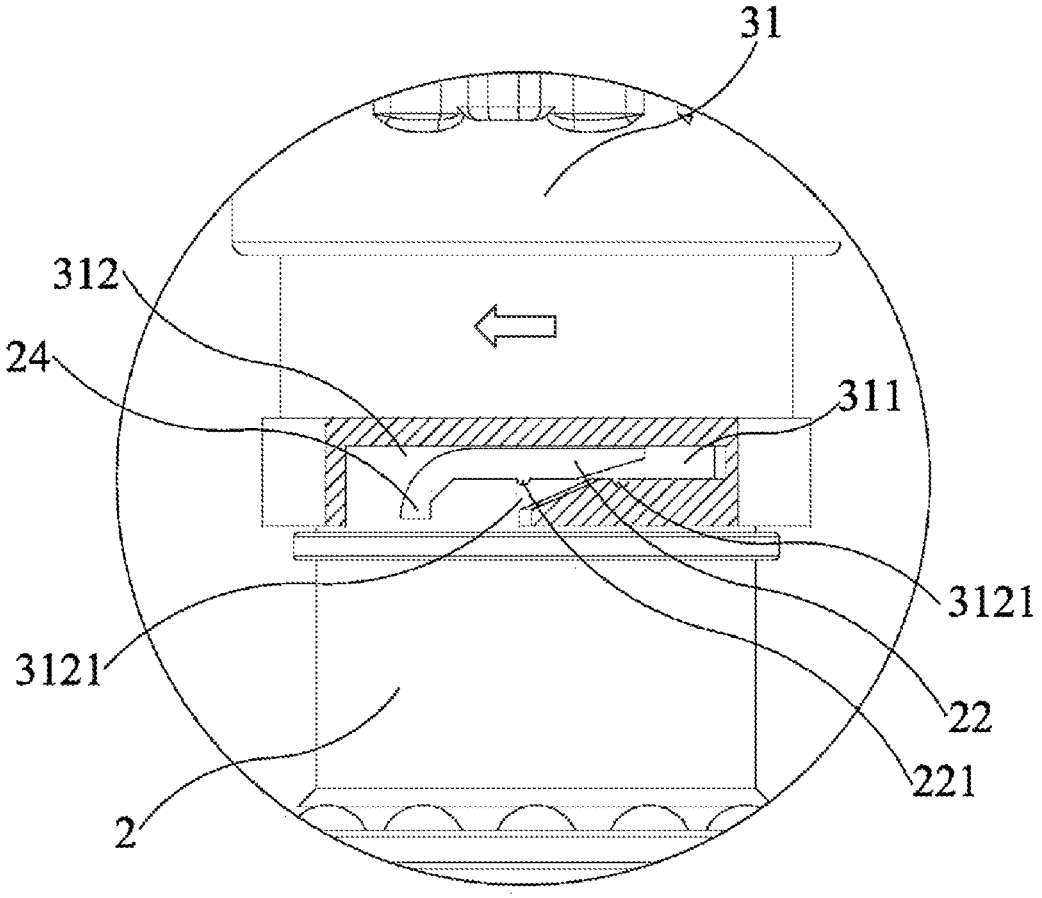
Figure 10:
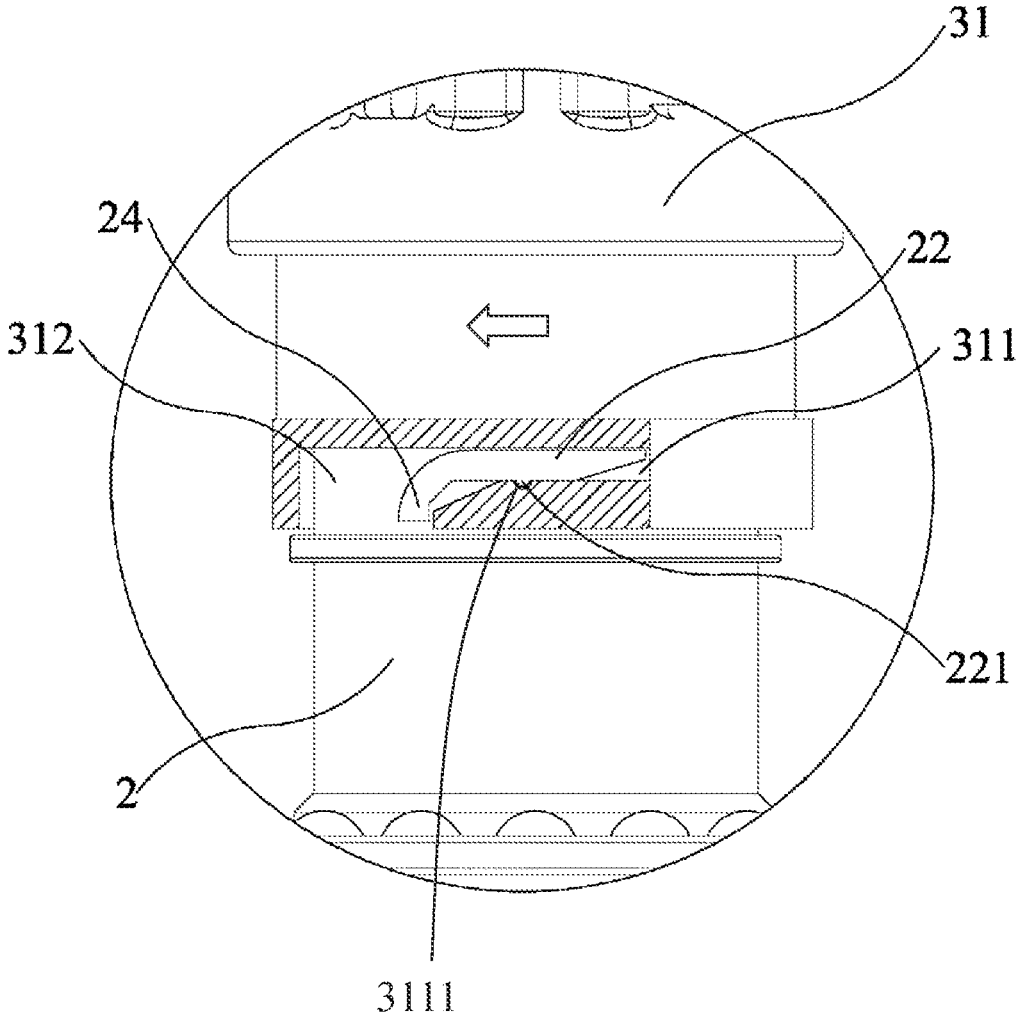

With the lower end 26 of the joint 2 in the rotationally locked configuration of FIG. 6, the water inlet hose 3 may be installed onto and/or removed from the upper end 28 of the stationary or locked joint 2 via rotation. An exemplary installation process is described below with reference to FIGS. 7-10, and it is understood that this installation process may be reversed to remove the water inlet hose 3 for cleaning, repair, storage, or another purpose. In FIG. 7, the coupling 31 of the water inlet hose 3 (FIG. 6) is positioned onto the upper end 28 of the joint 2, with the mounting groove 312 of the coupling 31 aligned with the mounting rib 22 of the joint 2. In FIG. 8, the coupling 31 is moved downward to receive the mounting rib 22 of the joint 2 through the open bottom end of the mounting groove 312 of the coupling 31. In FIG, 9, the coupling 31 is rotated (e.g., clockwise) to introduce the mounting rib 22 of the joint 2 into the mounting hole 311 of the coupling 31. In FIG. 10, the coupling 31 is rotated further (e.g., clockwise) to tightly capture the mounting rib 22 of the joint 2 in the mounting hole 311 of the coupling 31. In this position, the locking recess 3111 of the coupling 31 receives the locking protrusion 221 of the joint 2, which secures the components firmly together. The coupling 31 may contact the stop 24 of the joint 2 to prevent further rotation of the coupling 31. It is also within the scope of the present disclosure to utilize a threaded or other rotational coupling between the joint 2 and the coupling 31.

After installing the water inlet hose 3, the joint 2 may resume the rotatable configuration of FIG. 5 by returning the pool cleaner 1 to the pool. The joint 2 may float upward, thereby freeing the rotation-locking slots 211 of the flange 21 from the rotation-locking protrusion 1211 of the water inlet 121 and allowing the joint 2 to resume rotation relative to the water inlet 121,

II. Second Embodiment with Rotatable Joint and Lockable Hose

FIGS. 11-15 provide a second embodiment of a pool cleaner 1' configured to clean a floor and/or sidewalls of a pool. The second pool cleaner 1' is similar to the above-described pool cleaner 1 of FIG. 1, with like reference numerals identifying like parts, except as described below.

The pool cleaner 1' includes a housing 11' that defines a through-hole 111' in its upper surface. The pool cleaner 1' also includes a hydraulic driving assembly 12' including a water inlet 121' adjacent to the through-hole 111', opposing forward and rearward water outlets **122*f'*, 122*r'*, respectively, and an impeller 124' disposed within the housing 11'. The pool cleaner 1' also includes a filtration assembly 14' disposed within the housing 11' to collect debris. The pool cleaner 1' further includes a transmission assembly 16' operably coupled to the driving assembly 12' and one or more wheels 18' or other traction assemblies (e.g., tracks) operably coupled to the transmission assembly 16'**.

The pool cleaner 1' also includes a joint 2' configured to receive a flexible water inlet hose 3'. The joint 2' has a rotatable or use configuration that allows the water inlet hose 3' to rotate relative to the housing 11' during use. The water inlet hose 3' has a locked or non-use configuration that facilitates installation and/or removal of the water inlet hose 3' via rotation of the joint 2' when not in use. In the illustrated embodiment of FIG. 11, the joint 2' is externally threaded and the water inlet hose 3' is internally threaded. However, it is also within the scope of the present disclosure to utilize another rotational coupling between the joint 2' and the water inlet hose 3', such as the rotational coupling described above with respect to FIGS. 7-10.

Figure 12:
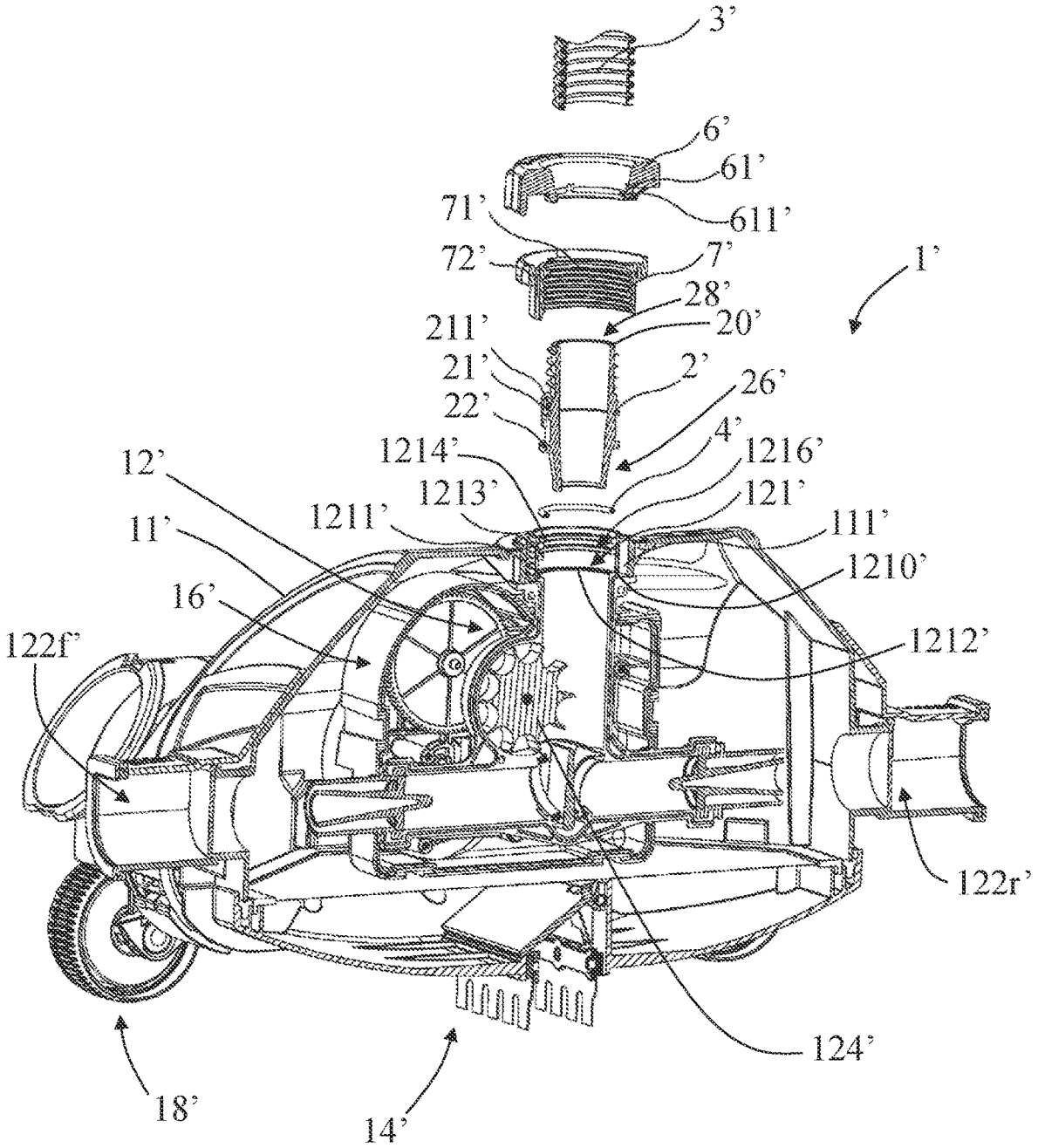
FIG. 12 is an exploded, cross-sectional view of the second pool cleaner of FIG. 11.
Figure 13:
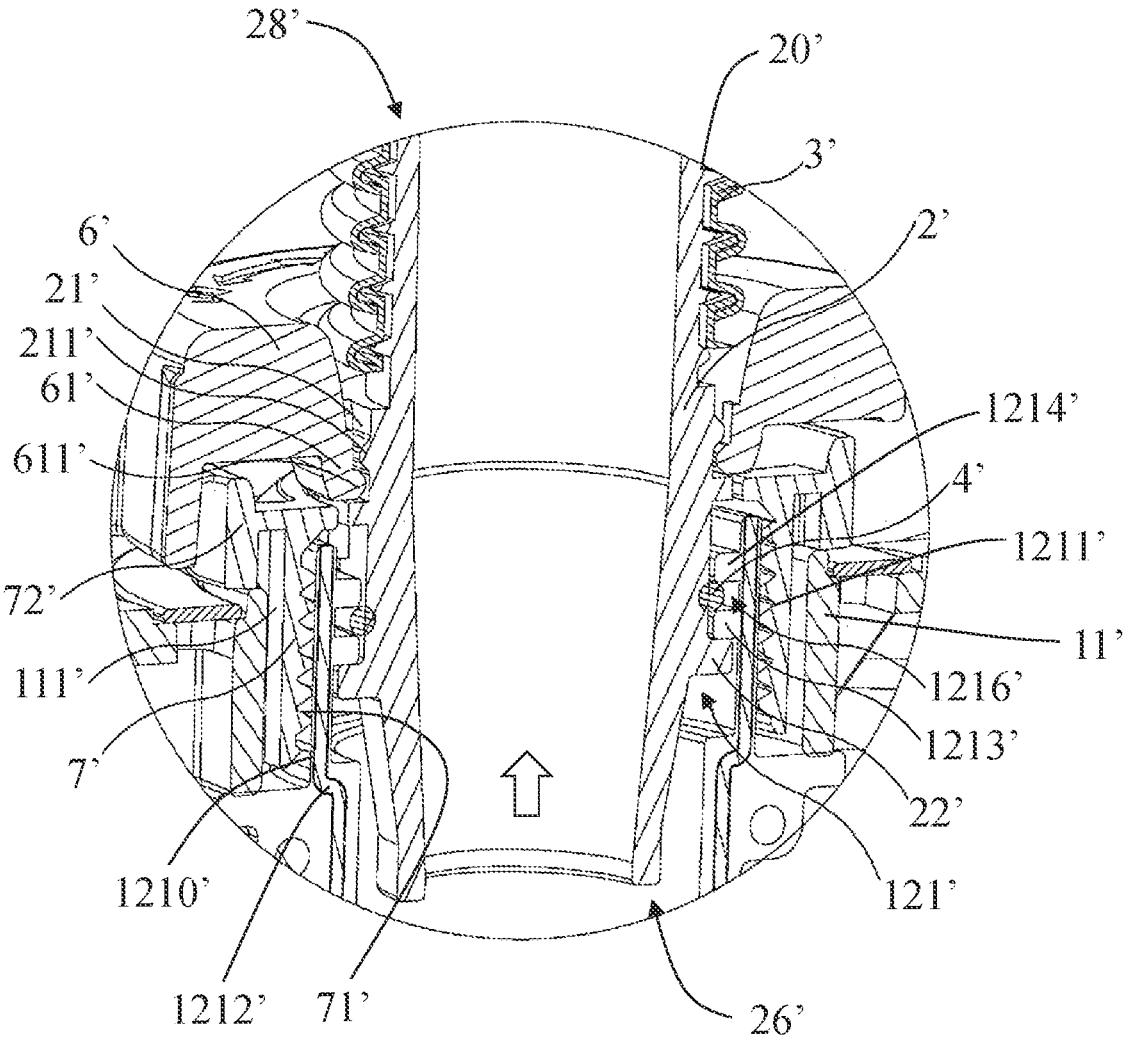
FIG. 13 is an enlarged view of the circled area of FIG. 11.
Figure 14:
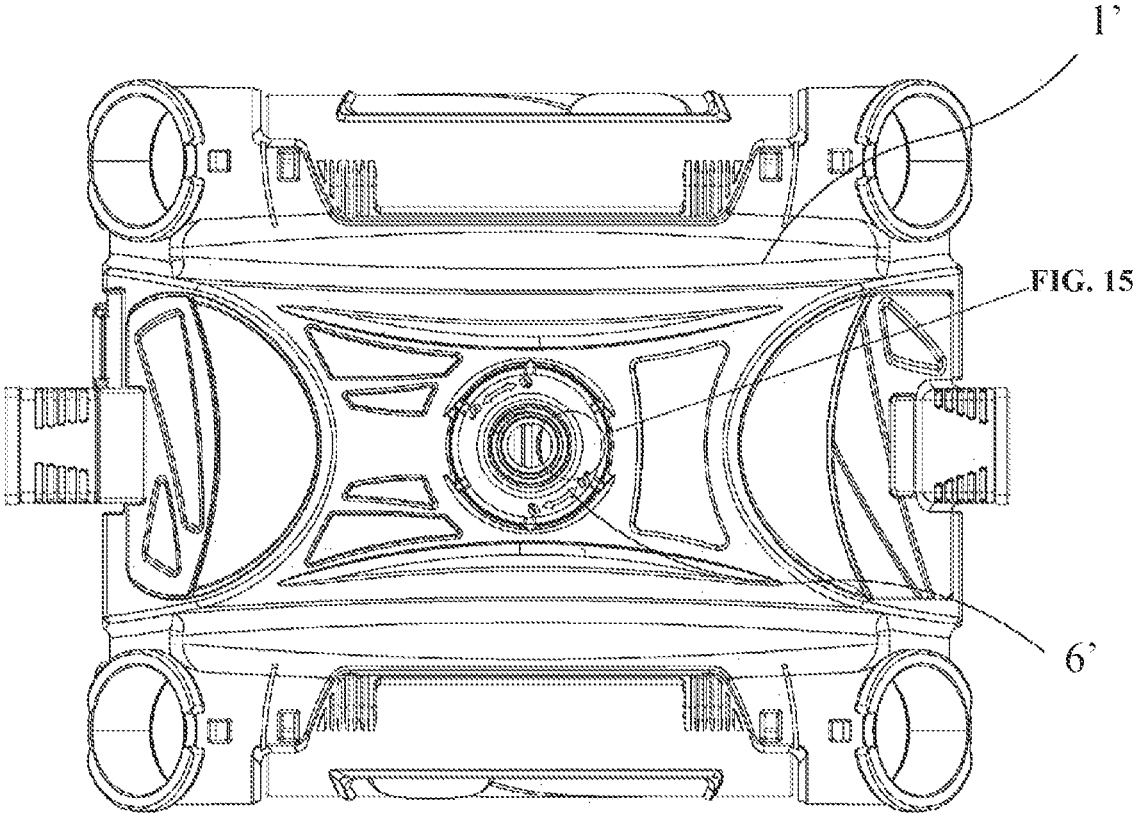
FIG. 14 is a top plan view of the second pool cleaner of FIGS. 11.
Figure 15:
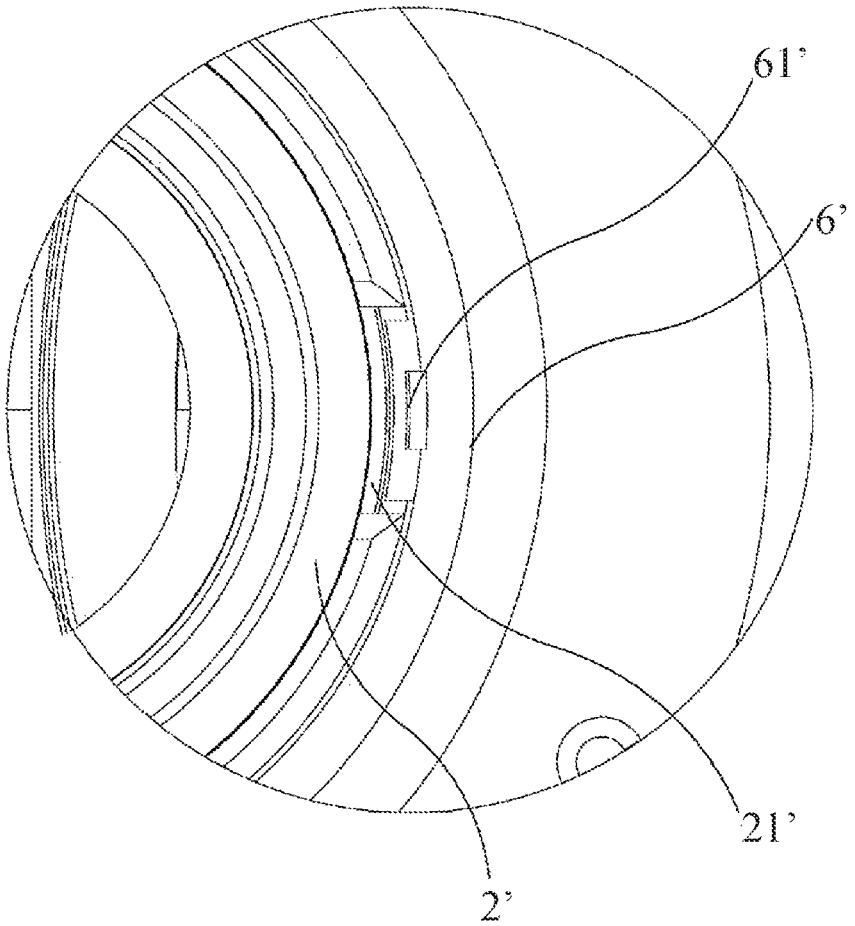
FIG. 15 is an enlarged view of the circled area of FIG. 14.

The water inlet 121' of the driving assembly 12' is shown in FIGS. 12 and 13 and includes a cylindrical side wall 1210'. An external thread 1211' extends radially outward from the side wall 1210'. A lower flange or base 1212', an intermediate flange 1213', and an upper flange 1214' each extend radially inward from the side wall 1210'. The intermediate flange 1213' and the upper flange 1214' cooperate to define an internal groove 1216' that is configured to receive a seal 4' (e.g., an O-ring).

The water inlet 121' is coupled to a lock nut 7'. The lock nut 7' includes an internal thread 71' that engages the external thread 1211' of the water inlet 121'. The lock nut 7' also includes an outer edge 72' positioned above the through-hole 111' of the housing 11' and having an outer diameter larger than the inner diameter of the through-hole 111' to prevent the lock nut 7' (and the water inlet 121' coupled to the lock nut 7') from dropping through the through-hole 111'. In this way, the lock nut 7' supports the water inlet 121' in the housing 11'.

The joint 2' is shown in FIGS. 12 and 13 and includes a generally cylindrical side wall 20' that extends between a lower end 26' and an upper end 28'. The illustrative joint 2' tapers in width toward the lower end 26', but this shape may vary. The joint 2' includes an external slot 21' that extends axially along the side wall 20' from an open end toward the upper end 28' to a locking recess 211' toward the lower end 26'. Near the lower end 26', the joint 2' includes a flange 22' that extends radially outward from the side wail 20'. At the upper end 28', the joint 2' is externally threaded to mate with the internally threaded water inlet hose 3', as described above.

The joint 2' is rotatably coupled to a rotary sleeve 6'. The rotary sleeve 6' includes an elastic arm 61' with a locking tip 611' that is biased radially inward to engage the joint 2' (See also FIGS. 14 and 15). The rotary sleeve 6' may he coupled to the joint 2' by sliding the elastic arm 61' downward through the external slot 21' until the locking tip 611' snaps radially inward into the locking recess 211'. The rotary sleeve 6' is positioned above the through-hole 111', and the outer diameter of the rotary sleeve 6' exceeds the inner diameter of the through-hole 111' to prevent the rotary sleeve 6' (and the joint 2' coupled to the rotary sleeve 6') from dropping through the through-hole 111' and into the water inlet 121', The rotary sleeve 6' is also positioned above the lock nut 7' and is accessible by the user.

Figure 11:
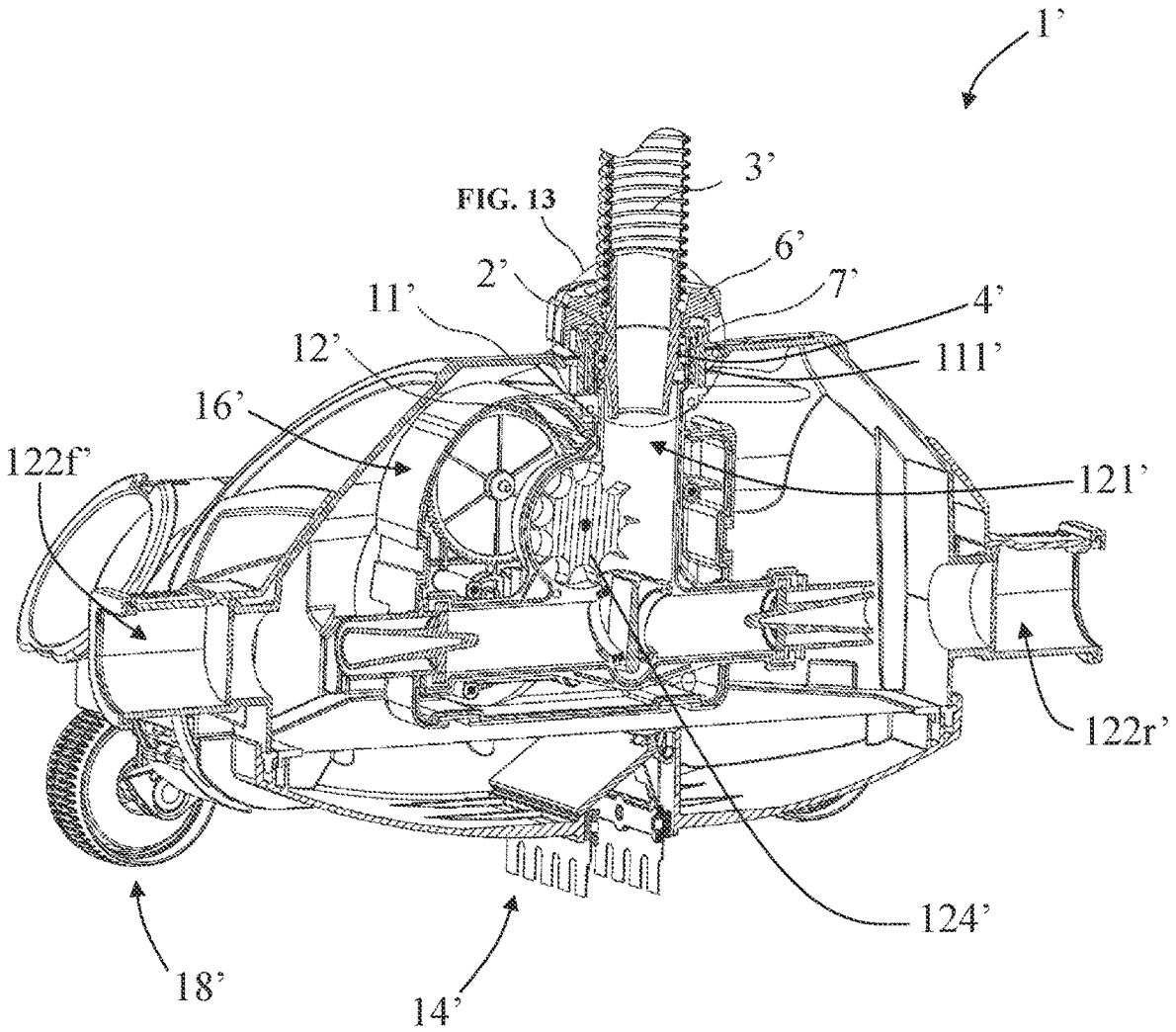
FIG. 11 is a perspective, cross-sectional view of a second pool cleaner including an exemplary joint coupled to a water inlet hose.

The joint 2' is shown in the rotatable or use configuration in FIG. 13, in which the joint 2' is positioned in the pool and floats upward in the water. The flange 22' of the joint 2' is captured beneath the intermediate flange 1213' of the water inlet 121', thereby limiting upward movement of the joint 2'. The seal 4' is captured. in the groove 1216' of the water inlet 121' and contacts the rotatable joint 2', which ensures a water-tight pathway from the joint 2' to the water inlet 121'. In this rotatable configuration, the joint 2' is free to rotate relative to the housing 11' and the water inlet 121'. As noted above, the rotatable joint 2' avoids entangling of the water inlet hose 3' during hack-and-forth movement of the pool cleaner 1' (FIG. 11).

In the locked or non-use configuration not shown), the joint 2' is removed from the pool and falls downward into the water inlet 121' due to gravity. The flange 22' of the joint 2' contacts the base 1212' of the water inlet 121'. The flange 22' has an outer diameter larger than the inner diameter of the base 1212', thereby limiting downward movement of the joint 2' and preventing the joint 2' from failing into the water inlet 121'. The user may grip the water inlet hose 3' with one hand to restrict the water inlet hose 3' from rotating relative to the housing 11', thereby fixing the position of the water inlet hose 3' relative to the housing 11'. Then, the user may rotate the exposed rotary sleeve 6' relative to the stationary water inlet hose 3' with the other hand. Because the locking tip 611' of the rotary sleeve 6' is engaged with the locking recess 211' of the joint 2', this rotation of the rotary sleeve 6' also rotates the joint 2' relative to the stationary water inlet hose 3'. Such rotation of the rotary sleeve 6' may be performed to attach and/or detach the joint 2' and the water inlet hose 3'.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pool cleaner configured to clean a pool, the pool cleaner comprising:
- a housing having a through-hole;
- a flexible water inlet hose;
- a hydraulic driving assembly including a water inlet;
- at least one traction assembly operably coupled to the driving assembly; and
- a joint extending through the through-hole of the housing and including an upper end in fluid communication with the water inlet hose and a lower end in fluid communication with the water inlet;
- wherein the pool cleaner has:
  - a rotatable configuration in which the flexible water inlet hose and the joint are coupled together and rotatable together relative to the housing; and
  - a locked configuration in which one of the joint and the water inlet hose is a locked component that is restricted from rotating relative to the housing and the other of the joint and the water inlet hose is a rotatable component that is rotatable relative to the housing, wherein the joint and the water inlet hose are selectively coupled together via rotation of the rotatable component relative to the locked component in the locked configuration.

2. The pool cleaner of claim 1, wherein:
- in the rotatable configuration, the joint floats upward in the housing; and
- in the locked configuration, the joint falls downward in the housing due to gravity.

3. The pool cleaner of claim 1, wherein the joint is the locked component and the water inlet hose is the rotatable component in the locked configuration.

4. The pool cleaner of claim 3, wherein:
- the water inlet includes at least one locking protrusion; and
- the joint includes at least one locking slot that is separated from the at least one locking protrusion in the rotatable configuration and engaged with the at least one locking protrusion in the locked configuration.

5. The pool cleaner of claim 3, wherein:
- the joint includes a mounting rib; and
- the water inlet hose includes a mounting hole that is rotatable relative to the mounting rib in the locked configuration to selectively couple the joint and the water inlet hose together.

6. The pool cleaner of claim 5, wherein:
- the mounting rib of the joint includes a locking protrusion; and
- the mounting hole of the water inlet hose includes a locking recess that receives the locking protrusion to secure the joint and the water inlet hose together.

7. The pool cleaner of claim 1, wherein the water inlet hose is the locked component and the joint is the rotatable component in the locked configuration.

8. The pool cleaner of claim 7, further comprising a rotary sleeve coupled to the joint and configured to rotate the joint relative to the water inlet hose in the locked configuration.

9. The pool cleaner of claim 8, wherein the rotary sleeve is positioned atop the housing.

10. The pool cleaner of claim 1, wherein the water inlet hose and the joint are threaded together.

11. The pool cleaner of claim 1, further comprising a bearing positioned between the joint and the housing.

12. The pool cleaner of claim 1, further comprising a seal positioned between the joint and the water inlet.

13. A pool cleaner configured to clean a pool, the pool cleaner comprising:

a housing having a through-hole;

a flexible water inlet hose a hydraulic driving assembly including a water inlet;

at least one traction assembly operably coupled to the driving assembly; and a joint extending through the through-hole of the housing and including an upper end in fluid communication with the water inlet hose and a lower end in fluid communication with the water inlet;

wherein the joint has:

a rotatable configuration in which the lower end of the joint is rotatable relative to the water inlet; and a locked configuration in which the lower end of the joint is restricted from rotating relative to the water inlet and the water inlet hose is rotatable relative to the upper end of the joint.

14. The pool cleaner of claim 13. wherein:

the water inlet includes at least one locking protrusion;

the joint includes at least one locking slot;

in the rotatable configuration, the at least one locking slot floats above the at least one locking protrusion; and in the locked configuration, the at least one locking slot moves downward and engages the at least one locking protrusion.

* * * * *